United States Patent [19]

Tanabe et al.

[11] 4,317,484

[45] Mar. 2, 1982

[54] HEAT EXCHANGER CORE

[75] Inventors: Zenichi Tanabe, Nagoya; Toshiyasu Fukui; Hiroshi Ikeda, both of Toyoake; Tatsuo Miura, Kariya; Taketoshi Sugiura, Okazaki, all of Japan

[73] Assignees: Sumitomo Light Metal Industries, Ltd., Tokyo; Nippondenso Co., Ltd., Kariya, both of Japan

[21] Appl. No.: 158,744

[22] Filed: Jun. 12, 1980

[51] Int. Cl.[3] ..... F28F 19/06

[52] U.S. Cl. ..... 165/134 R; 165/180

[58] Field of Search ..... 165/134 R, 180, DIG. 8

[56] References Cited

U.S. PATENT DOCUMENTS

| | | | |
|---|---|---|---|
| 3,960,208 | 6/1976 | Anthony et al. | 165/134 R X |
| 4,203,490 | 5/1980 | Terai et al. | 165/134 R |
| 4,209,059 | 6/1980 | Anthony et al. | 165/134 R X |

OTHER PUBLICATIONS

Aluminum Mill Products, Metals Handbook, 9th Edition, vol. 2, By the American Society for Metals Committee on Aluminum and Aluminum Alloys, pp. 44–45.

Nominal Chemical Composition–Wrought Alloys, Engineering Alloys, 5th Edition, by Weldman and Gibbons, p. 1374.

*Primary Examiner*—Sheldon J. Richter

*Attorney, Agent, or Firm*—Blanchard, Flynn, Thiel, Boutell & Tanis

[57] ABSTRACT

The heat exchanger core comprises a fluid passage member within which a fluid flows and outside of which another fluid flows, and fin members formed on the fluid passage member for promoting heat exchange between the two fluids, and the fluid passage member and the fin members are made of different kinds of aluminum alloys, and the fin members serve as sacrificial anodes as well as for protecting the heat exchanger core from corrosion.

6 Claims, 3 Drawing Figures

HEAT EXCHANGER CORE

BACKGROUND OF THE INVENTION

The present invention relates to a heat exchanger core comprising a fluid passage member within which a fluid flows and outside of which another fluid flows and fin members formed thereon for promoting heat exchange between the two fluids, and more particularly to a heat exchanger core whose fluid passage member is made of an aluminum base alloy and whose fin members also serve as sacrificial anodes for protecting the fluid passage member from corrosion, when the heat exchanger core is used in the heat exchangers for condensers of car coolers or for radiators of cars.

A conventional heat exchanger for use in air-cooled heat exchangers, which is made of an aluminum base alloy and is assembled by brazing, comprises a fluid passage member for allowing a heat exchange medium, such as cooling medium or cooling water, to pass therethrough, and fin members disposed on the air-cooled side. In the heat exchanger, either the fluid passage member or the cooling fin members or both are prepared from brazing sheets comprising a layered member consisting of a core metal layer made of aluminum or a corrosion-resistant aluminum alloy, and a cleaning metal layer made of an Al-Si base alloy or an Al-Si-Mg base alloy, and these members are joined to each other by brazing.

However, when the heat exchanger is exposed to a severe corrosive atmosphere, considerable corrosion takes place in the air-cooled side of the heat exchanger and the fluid may leak from the fluid passage member. Therefore, the applications of such an air-cooled heat exchanger are severely limited. More specifically, in the conventional heat exchanger as shown in FIG. 1, a soldered fillet portion 2 between a fin member 1 and a fluid passage member 3 becomes a cathode, while the fluid passage member 3 itself becomes an anode, and a corrosion-current flows in the direction of the arrow from the fluid passage member 3 to the soldered fillet portion 2, so that pitting corrosion 4 occurs in the fluid passage member 3.

SUMMARY OF THE INVENTION

It is therefore an object of the present invention to provide a corrosion-resistant heat exchanger core.

According to the present invention, fin members which are attached to the outer surface of the fluid passage member for increasing heat exchange efficiency serve as sacrificial anodes by an appropriate combination of the materials for use in the heat exchanger core and the fin members, so that the fluid passage member is protected from corrosion, while the corrosion of the fin members is minimized.

The heat exchanger core according to the present invention can find wide application since corrosion of the fluid passage member is prevented by the fin members.

DETAILED DESCRIPTION OF THE PREFERRED EMBODIMENT

Figure 1:
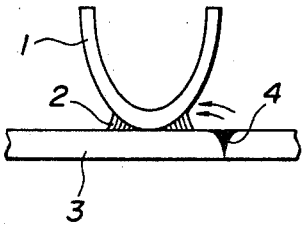
FIG. 1 Prior Art
FIG. 1 illustrates a corrosion state of part of a conventional heat exchanger core.
Figure 2:
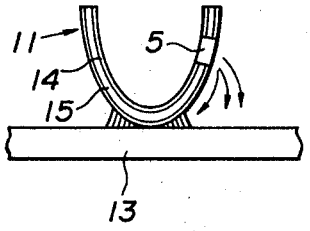
FIG. 2 illustrates the function of a sacrificial anode according to the present invention.

Referring to FIG. 2, there is schematically shown part of an embodiment of a heat exchanger core according to the present invention. In this embodiment, a fin member 11 made of a brazing sheet consisting of a core metal layer 15 and cladding metal layers 14 becomes an anode, while a fluid passage member 13 becomes a cathode, so that the corrosion-current flows in the direction of the arrow from the fin member 11 to the fluid passage member 13 and to a brazed fillet portion 12 and therefore pitting corrosion 5 occurs in the fin member 11, whereby the fluid passage member 13 is protected from corrosion.

In order that the fluid passage member 13 is protected from corrosion in the above-mentioned manner, it is required that the corrosion-current flow through the whole outer surface of the fluid passage member 13 and, at the same time, it is required that the rate of corrosion of the fin member 11 be minimized.

In order to satisfy the above-mentioned requirements, the heat exchanger cores according to the present invention comprise fin members made of a brazing sheet consisting of a core metal layer and a cladding metal layer, and a fluid passage member. More specifically, in a first embodiment of a heat exchanger core according to the present invention, the core metal layer is made of an aluminum base alloy containing Sn in the range of 0.01 to 0.09 wt.%, and the cladding metal layer is made of a brazing material comprising an Al-Si base alloy or an Al-Si-Mg base alloy, and the fluid passage member is made of a corrosion-resistant aluminum base alloy containing Mn in the range of 0.2 to 2 wt%.

In a second embodiment of a heat exchanger core according to the present invention, the core metal layer is made of an aluminum-base alloy, which contains Sn in the range of 0.01 to 0.09 wt.% and at least one substance selected from the group consisting of Mg in the range of 0.1 to 2 wt.%, Mn in the range of 0.1 to 2 wt.%, Zn in the range of 0.1 to 5 wt.%, Cu in the range of 0.01 to 2 wt.%, Cr in the range of 0.01 to 0.05 wt.%, Zr in the range of 0.01 to 0.5 wt.%, Fe in the range of 0.01 to 2 wt.%, and Si in the range of 0.01 to 1 wt.%, and the cladding metal layer is made of a soldering material comprising an Al-Si base alloy or an Al-Si-Mg base alloy, and the fluid passage member is made of a corrosion-resistant aluminum base alloy containing Mn in the range of 0.2 to 2 wt.%.

In a third embodiment of a heat exchanger core according to the present invention, the core metal layer is made of an aluminum base alloy containing Sn in the range of 0.01 to 0.09 wt.%, and the cladding metal layer is made of a soldering material comprising an Al-Si base alloy or an Al-Si-Mg base alloy, and the fluid passage member is made of a corrosion-resistant aluminum base alloy containing Mn in the range of 0.2 to 2 wt.% and at least one substance selected from the group consisting of Mg in the range of 0.1 to 2 wt.%, Cr in the range of 0.01 to 5 wt.%, Ti in the range of 0.01 to 0.5 wt.%, Zr in the range of 0.01 to 0.5 wt.%, Cu in the range of 0.01 to 1 wt.%, Fe in the range of 0.01 to 1 wt.% and Si in the range of 0.01 to 2 wt.%.

In a fourth embodiment of a heat exchange core according to the present invention, the core metal layer is made of an aluminum-base alloy containing Sn in the range of 0.01 to 0.09 wt.% and at least one substance selected from the group consisting of Mg in the range of 0.1 to 2 wt.%, Mn in the range of 0.1 to 2 wt.%, Zn in the range of 0.1 to 5 wt.%, Cu in the range of 0.01 to 2 wt.%, Cr in the range of 0.01 to 0.5 wt.%, Zr in the range of 0.01 to 0.5 wt.%, Fe in the range of 0.01 to 2 wt.%, and Si in the range of 0.01 to 1 wt.%, and the cladding metal layer is made of a soldering material comprising an Al-Si base alloy or an Al-Si-Mg base alloy, and the fluid passage member is made of a corrosion-resistant aluminum-base alloy containing Mn in the range of 0.2 to 2 wt.% and at least one substance selected from the group consisting of Mg in the range of 0.1 to 2 wt.%, Cr in the range of 0.01 to 5 wt.%, Ti in the range of 0.01 to 0.5 wt.%, Zr in the range of 0.01 to 0.5 wt.%, Cu in the range of 0.01 to 1 wt.%, Fe in the range of 0.01 to 1% and Si in the range of 0.01 to 2 wt.%.

In the brazing sheet which constitutes the fin members in the present invention, the aluminum base alloy of the core metal layer contains Sn in the range of 0.01 to 0.09 wt.%. The Sn contained serves to make the fin members anodic, so that each of the fin members serves as a sacrificial anode for preventing the fluid passage member from being corroded. When the content of Sn exceeds the above-mentioned range, the plasticity of the aluminum base alloy decreases so that it becomes difficult to form the brazing sheet into the desired shape to make the fin members and, at the same time, considerable self-corrosion tends to take place in the fin members. On the other hand, when the content of Sn is less than the lower limit, the desired corrosion prevention effect is not obtained.

The other substances, such as Mg, Mn, Cu, Cr, Zr, Fe and Si, which can be contained in the fin members, serve to improve strength, sag-resistance, and moldability of the fin members. When the contents of those substances exceed their respective upper limits which have been previously mentioned, the plasticity for molding is lowered. On the other hand, when the contents of those substances are less than their previously mentioned respective lower limits, they do not contribute to improvement of strength, sag-resistance, and moldability of the fin members.

Zn provides the fin members with the sacrificial anode effect and promotes the effect of Sn. When the content of Zn exceeds its upper limit, brazing capability of the fin members is lowered and when the content of Zn is less than its lower limit, the corrosion prevention effect is decreased.

The fluid passage member according to the present invention is characterized by containing Mn in the range of 0.2 to 2 wt.%. The Mn makes the fluid passage member cathodic so as to increase the difference of potential between the fluid passage member and the fin members. Consequently, the sacrificial anode effect of the fin members is increased. Therefore, the fluid passage member is protected from corrosion. When the content of Mn exceeds its upper limit, the workability of the aluminum alloy for the fluid member is reduced. On the other hand, when the content of Mn is less than its lower limit, the corrosion prevention effect is reduced.

The other substances that can be added to the fluid passage member, such as Mg, Cr, Ti, Zr, Cu, Fe and Si, serve to increase strength of the fluid passage member and to make the surface of the fluid passage member smooth by rendering the size of alloy crystals minute, without changing the potential of the fluid passage member greatly. When the contents of these substances exceed their respective upper limits, the workability of the aluminum alloy for the fluid passage member is reduced. On the other hand, when the contents of those substances are less than their respective lower limits, the effects of improving the strength and of refining the alloy crystals cannot be obtained.

In the cladding metal layer of the fin members, an Al-6-14%-Si alloy and an Al-6-14%-Si-0.3-2.0%-Mg alloy can be used equally. Furthermore, an Al-6-14%-Si alloy containing a small amount of Bi, Sr, Ba, Sb and/or Be can be used in the cladding metal layer.

As the brazing method for use in the present invention for making the heat exchange core, a flux method, a vacuum method, a low pressure atmosphere method and an inert gas atmosphere method can be used equally.

Figure 3:
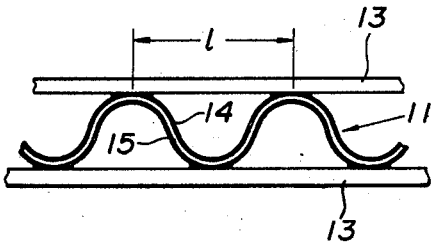
FIG. 3 illustrates the fin pitch of a corrugated type fin member according to the present invention.

By defining the composition of the aluminum alloy for use in the fin members and the fluid passage member as mentioned above, an excellent sacrificial anode effect can be obtained in the present invention. As mentioned previously, in order to obtain the sacrificial anode effect, it is required that corrosion-current for preventing corrosion be supplied to the whole outer surface of the fluid passage member. In order to attain this, in the case of a corrugated type fin members as shown in FIG. 3, it is required that the surface area of the fin members be 2.5 or more times the outer surface of the fluid passage member and that the fin pitch l be not more than 10 mm. When the above-mentioned area ratio is less than 2.5 and the fin pitch is greater than 10 mm, corrosion current becomes insufficient and corrosion takes place in part of the fluid passage member.

Table 1 through Table 4 summarize the embodiments of heat exchanger cores according to the present invention together with their test results.

Table 1 shows the chemical composition of a variety of fluid passage members tested in the present invention. In the table, A11 and A12 represent comparative examples. The main component of each fluid passage member is Al.

TABLE 1

Chemical Composition of Tested Aluminum Alloys for Fluid Passage Members

| | Chemical Composition (%) | | | | | | | |
|---|---|---|---|---|---|---|---|---|
| No. | Mn | Mg | Cr | Ti | Zr | Cu | Fe | Si |
| A1 | 0.3 | 0.3 | | | | | | |
| A2 | 0.3 | 0.5 | 0.1 | | | | | |
| A3 | 0.6 | | | 0.1 | | | | |
| A4 | 0.6 | | | | 0.1 | | | |
| A5 | 1.2 | | | | | 0.2 | | |
| A6 | 1.2 | | | | | | 0.5 | |
| A7 | 1.5 | 0.3 | | | | | | 0.2 |
| A8 | 1.8 | | | | 0.1 | 0.1 | 0.3 | |
| A9 | 0.2 | | | | | | | |
| A10 | 2 | | | | | | | |
| A11 | | | | | | | 0.2 | 0.1 |
| A12 | 0.1 | 0.1 | | | | 0.1 | | |

Table 2 shows the chemical composition of the core metal layers of a variety of brazing sheets for making fin members. In the cladding layer in each brazing sheet, Al-10% Si-1.5% Mg alloy was employed. In the table, B11 and B12 represent comparative examples. The main component of the core metal layer of each brazing sheet is Al.

TABLE 2

Chemical Composition of Core Metal Layers of Brazing Sheets

| No. | Chemical Compositions (%) Sn | Mn | Mg | Zn | Cu | Cr | Zr | Fe | Si |
|---|---|---|---|---|---|---|---|---|---|
| B1 | 0.03 | | | 1.0 | | | | | |
| B2 | 0.04 | | | | 0.1 | | | | |
| B3 | 0.04 | | | | | 0.1 | | | |
| B4 | 0.05 | | | | | | 0.1 | | |
| B5 | 0.05 | | | | | | | 0.5 | |
| B6 | 0.06 | | 0.6 | | | | | | 0.4 |
| B7 | 0.06 | 1.2 | | | | | | | |
| B8 | 0.08 | 1.0 | 0.5 | | 0.1 | | | | |
| B9 | 0.01 | | | | | | | | |
| B10 | 0.09 | | | | | | | | |
| B11 | | | | | | | | 0.5 | 0.2 |
| B12 | 0.005 | 1.2 | | | 0.1 | | | 0.5 | 0.2 |

Table 3 summarizes the results of measurement of potentials of the aluminum alloys listed in Table 1 and the brazing sheets of Table 2.

TABLE 3

Measurement of Potentials of Aluminum Alloys Listed in Table 1 and Table 2

| Fluid Passage Member No. | Potential (V) | Brazing Sheet No. | Potential (V) |
|---|---|---|---|
| A1 | −0.69 | B1 | −0.79 |
| A2 | −0.69 | B2 | −0.76 |
| A3 | −0.68 | B3 | −0.78 |

TABLE 3-continued

Measurement of Potentials of Aluminum Alloys Listed in Table 1 and Table 2

| Fluid Passage Member No. | Potential (V) | Brazing Sheet No. | Potential (V) |
|---|---|---|---|
| A4 | −0.68 | B4 | −0.78 |
| A5 | −0.66 | B5 | −0.77 |
| A6 | −0.67 | B6 | −0.76 |
| A7 | −0.67 | B7 | −0.77 |
| A8 | −0.66 | B8 | −0.78 |
| A9 | −0.69 | B9 | −0.75 |
| A10 | −0.67 | B10 | −0.79 |
| A11 | −0.74 | B11 | −0.73 |
| A12 | −0.73 | B12 | −0.72 |

(note) The potential in a 3% NaCl aqueous solution, using a saturated calomel reference electrode.

Table 4 summarizes the construction of each embodiment of a heat exchanger core according to the present invention and the results of corrosion testing with respect to each embodiment. In the table, No. 22 through No. 26 are comparative examples.

TABLE 4

Construction of Heat Exchanger Cores and Their Corrosion Tests

| No. | Materials: Fluid passage member (pipe material) | Materials: Core Metal Layer of Brazing Sheet (Fin Members) | Construction of Heat Exchanger: Area[1] Ratio | Construction of Heat Exchanger: Fin Pitch (mm) | Maximum Depth of Pitting Corrosion (mm): Cass[2] Test (1 month) | Maximum Depth of Pitting Corrosion (mm): Alternate-[3] Wet and Dry Test (3 months) |
|---|---|---|---|---|---|---|
| 1 | A1 | B1 | 5 | 4 | 0.07 | 0.03 |
| 2 | A2 | B2 | 5 | 4 | 0.16 | 0.07 |
| 3 | A3 | B3 | 3 | 6 | 0.14 | 0.06 |
| 4 | A4 | B4 | 3 | 6 | 0.13 | 0.06 |
| 5 | A5 | B5 | 6 | 8 | 0.11 | 0.05 |
| 6 | A6 | B6 | 6 | 8 | 0.18 | 0.09 |
| 7 | A7 | B7 | 6 | 6 | 0.14 | 0.06 |
| 8 | A8 | B8 | 6 | 6 | 0.09 | 0.04 |
| 9 | A1 | B6 | 7 | 4 | 0.16 | 0.07 |
| 10 | A2 | B4 | 7 | 4 | 0.18 | 0.09 |
| 11 | A3 | B2 | 7 | 6 | 0.17 | 0.08 |
| 12 | A4 | B8 | 6 | 6 | 0.13 | 0.06 |
| 13 | A5 | B5 | 6 | 6 | 0.11 | 0.05 |
| 14 | A6 | B7 | 5 | 5 | 0.13 | 0.06 |
| 15 | A7 | B3 | 5 | 5 | 0.12 | 0.05 |
| 16 | A9 | B9 | 6 | 6 | 0.19 | 0.09 |
| 17 | A10 | B10 | 5 | 4 | 0.11 | 0.05 |
| 18 | A9 | B1 | 5 | 4 | 0.14 | 0.07 |
| 19 | A10 | B2 | 4 | 6 | 0.15 | 0.08 |
| 20 | A2 | B9 | 6 | 6 | 0.15 | 0.08 |
| 21 | A3 | B10 | 5 | 4 | 0.11 | 0.06 |
| 22 | A11 | B4 | 6 | 5 | 0.67 | 0.41 |
| 23 | A4 | B11 | 6 | 5 | 0.54 | 0.33 |
| 24 | A12 | B12 | 6 | 5 | 0.91 | 0.62 |
| 25 | A5 | B5 | 24 | 12 | 0.36 | 0.20 |
| 26 | A11 | B11 | 4 | 12 | 0.95 | 0.64 |

[1]Area Ratio = Area of Fin Member/Area of Fluid Passage Member (pipe).
[2]In accordance with Japanese Industrial Standard (JIS) H8681, a cass test was conducted for each sample for one month. When the maximum corroded depth was not more than 0.2 mm, the sample was judged good, and when the maximum corroded depth was 0.3 mm or more, the sample was judged defective.
[3]Alternate Wet and Dry Test: Each brased sample was immersed in a 3% NaCl aqueous solution (pH = 3) at 40° C. for 30 minutes, and was then dried at 50° C. for 30 minutes. This cycle was repeated for one month. After this test, when the maximum corroded depth was not more than 0.1 mm, the sample was judged good, and when the maximum corroded depth was 0.2 mm or more, the sample was judged defective.

In the above-mentioned embodiments and comparative examples, the thickness of the fluid passage member was 1.0 mm, and the thickness of the brazing sheet for the fin members was 0.16 mm, which was cladded on both sides with each cladding ratio being 12%.

The brazing was conducted at temperatures in the range of 590° C. to 610° C. at $10^{-5}$ torr over the period of 3 to 5 minutes.

As above mentioned, according to the present invention, heat exchanger core having highly improved corrosion resistance can be attained by the combination of the sacrificial fin member and the more noble fluid passage member whose potential is widely different from that of the fine member. Consequently, the heat exchanger core according to the present invention can be used for many purposes and is very useful in various applications.

What is claimed is:

1. A heat exchanger core comprising a fluid passage member within which a fluid is adapted to flow and outside of which another fluid is adapted to flow, and fin members mounted on the external surface of said fluid passage member; said fluid passage member being made of a first material selected from the group consisting of (1) a first aluminum alloy consisting essentially of aluminum and from 0.2 to 2.0 wt. % of manganese and (2) a second aluminum alloy consisting essentially of aluminum, from 0.2 to 2.0 wt. % of manganese and at least one substance selected from the group consisting of from 0.1 to 2.0 wt. % of magnesium, from 0.01 to 5 wt. % of chromium, from 0.01 to 0.5 wt. % of titanium, from 0.01 to 0.5 wt. % of zirconium, from 0.01 to 1.0 wt. % of copper, from 0.01 to 1.0 wt. % of iron and from 0.01 to 2.0 wt. % of silicon, said first material being effective to maintain said fluid passage member cathodic relative to said fin members; said fin members being made of a brazing sheet comprising a core metal layer and at least one cladding metal layer on said core layer, said core metal layer being made of a second material selected from the group consisting of (3) a third aluminum alloy consisting essentially of aluminum and from 0.01 to 0.09 wt. % of tin and (4) a fourth aluminum alloy consisting essentially of aluminum, from 0.01 to 0.09 wt. % of tin and at least one substance selected from the group consisting of from 0.1 to 2.0 wt. % of magnesium, from 0.1 to 2.0 wt. % of manganese, from 0.1 to 5.0 wt. % of zinc, from 0.01 to 2.0 wt. % of copper, from 0.01 to 0.5 wt. % of chromium, from 0.01 to 0.5 wt. % of zirconium, from 0.01 to 2.0 wt. % of iron, and from 0.01 to 1.0 wt. % of silicon, said second material being effective to maintain said fin members in an anodic state relative to said fluid passage member, said cladding metal layer being made of a brazing material selected from the group consisting of (5) a fifth aluminum alloy consisting essentially of aluminum and from 6 to 14 wt. % of silicon and (6) a sixth aluminum alloy consisting essentially of aluminum, from 6 to 14 wt. % of silicon and from 0.3 to 2.0 wt. % of magnesium; said fin members being soldered to the external surface of said fluid passage member and being effective as sacrificial anodes to protect said fluid passage member from corrosion.

2. A heat exchanger core as claimed in claim 1, wherein said core metal layer is made of said fourth aluminum alloy.

3. A heat exchanger core as claimed in claim 1 or claim 2, wherein said fluid passage member is made of said second aluminum alloy.

4. A heat exchanger core comprising a fluid passage member within which a fluid is adapted to flow and outside of which another fluid is adapted to flow, and fin members of sinuous shape, said fin members being mounted on the external surface of said fluid passage member, the ratio of the surface area of said fin members to the outer surface of said fluid passage member being at least 2.5 and the pitch of said sinuous fin members being not more than 10 mm; said fluid passage member being made of a first material selected from the group consisting of (1) a first aluminum alloy consisting essentially of aluminum and from 0.2 to 2.0 wt. % of manganese and (2) a second aluminum alloy consisting essentially of aluminum, from 0.2 to 2.0 wt. % of manganese and at least one substance selected from the group consisting of from 0.1 to 2.0 wt. % of magnesium, from 0.01 to 5 wt. % of chromium, from 0.01 to 0.5 wt. % of titanium, from 0.01 to 0.5 wt. % of zirconium, from 0.01 to 1.0 wt. % of copper, from 0.01 to 1.0 wt. % of iron and from 0.01 to 2.0 wt. % of silicon, said first material being effective to maintain said fluid passage member cathodic relative to said fin members; said fin members being made of a brazing sheet comprising a core metal layer and at least one cladding metal layer on said core layer, said core metal layer being made of a second material selected from the group consisting of (3) a third aluminum alloy consisting essentially of aluminum and from 0.01 to 0.09 wt. % of tin and (4) a fourth aluminum alloy consisting essentially of aluminum, from 0.01 to 0.09 wt. % of tin and at least one substance selected from the group consisting of from 0.1 to 2.0 wt. % of magnesium, from 0.1 to 2.0 wt. % of manganese, from 0.1 to 5.0 wt. % of zinc, from 0.01 to 2.0 wt. % of copper, from 0.01 to 0.5 wt. % of chromium, from 0.01 to 0.5 wt. % of zirconium, from 0.01 to 2.0 wt. % of iron, and from 0.01 to 1.0 wt. % of silicon, said second material being effective to maintain said fin members in an anodic state relative to said fluid passage member, said cladding metal layer being made of a brazing material selected from the group consisting of (5) a fifth aluminum alloy consisting essentially of aluminum and from 6 to 14 wt. % of silicon and (6) a sixth aluminum alloy consisting essentially of aluminum, from 6 to 14 wt. % of silicon and from 0.3 to 2.0 wt. % of magnesium; said fin members being soldered to the external surface of said fluid passage member and being effective as sacrificial anodes to protect said fluid passage member from corrosion.

5. A heat exchanger core as claimed in claim 4, wherein said core metal layer is made of said fourth aluminum alloy.

6. A heat exchanger core as claimed in claim 4 or claim 5, wherein said fluid passage member is made of said second aluminum alloy.

* * * * *